US006432500B1

(12) United States Patent
Jones et al.

(10) Patent No.: US 6,432,500 B1
(45) Date of Patent: Aug. 13, 2002

(54) LABEL WITH BOOKLET

(75) Inventors: Warren Jones; Timothy Laurence; Edward Bergmann; Hratch Satamian, all of Chatsworth, CA (US)

(73) Assignee: Pharmaceutic Litho & Label Company, Inc., Chatsworth, CA (US)

( * ) Notice: Subject to any disclaimer, the term of this patent is extended or adjusted under 35 U.S.C. 154(b) by 0 days.

(21) Appl. No.: 09/382,048

(22) Filed: Aug. 24, 1999

(51) Int. Cl.[7] ..... G09F 3/02; G09F 3/00; B42D 15/00

(52) U.S. Cl. ..... 428/40.1; 428/41.7; 428/41.3; 428/43; 428/343; 283/81; 283/101; 283/105; 40/638

(58) Field of Search ..... 428/40.1, 41.7, 428/41.9, 43, 343; 283/81, 100, 101, 103, 105; 40/638

(56) References Cited

U.S. PATENT DOCUMENTS 5,439,721 A * 8/1995 Pedroli et al. ..... 428/40.1
5,738,381 A * 4/1998 Treleaven et al. ..... 283/81
5,863,628 A * 1/1999 Barry ..... 428/40.1
6,057,019 A * 5/2000 Barry ..... 428/40.1

FOREIGN PATENT DOCUMENTS

DE 3310487 A * 9/1984

* cited by examiner

*Primary Examiner*—Shrive P. Beck
*Assistant Examiner*—Elena Tsoy
(74) *Attorney, Agent, or Firm*—Colin P. Abrahams

(57) ABSTRACT

A label with booklet comprises a liner material and a label having an upper and lower surface located on the liner. The label is secured to the liner by an adhesive layer on its lower surface such that the label can be peeled off the liner with the adhesive remaining on the lower surface of the label. A booklet is affixed to the upper surface of the label and comprises a plurality of stacked pages having edges including a top page and a bottom page, each of the pages being coextensive with each other and of smaller dimensions than the label. The booklet further comprises a cover member entirely covering the top page and extending beyond at least two opposing edges of the top page, the cover member having an upper non-adhesive surface, and a lower surface having an adhesive thereon by means of which the lower surface of the cover member is permanently adhered to the upper surface of the top page. The booklet is completely removable from the label by removing at least a portion of the cover member.

14 Claims, 2 Drawing Sheets

FIG. 1
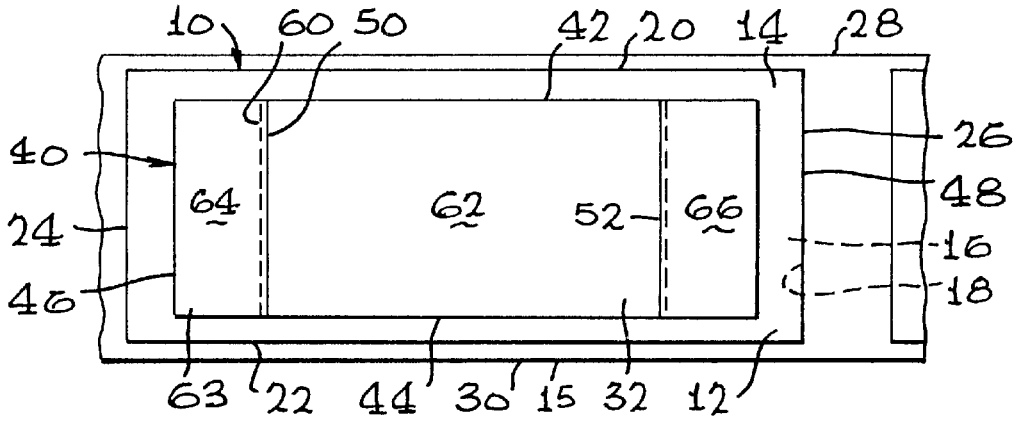
FIG. 2
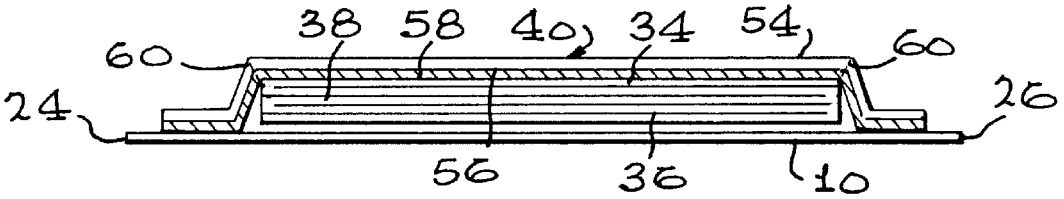
FIG. 4
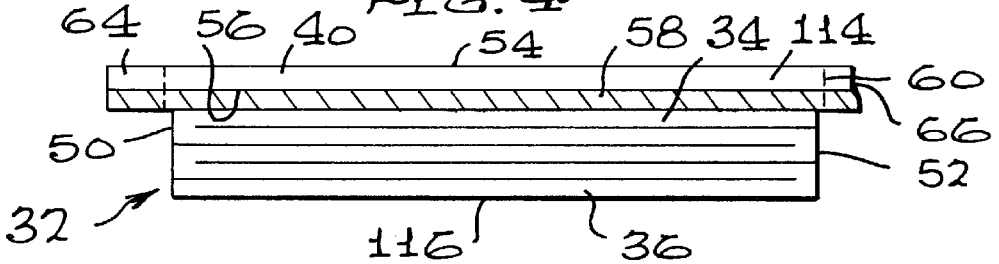
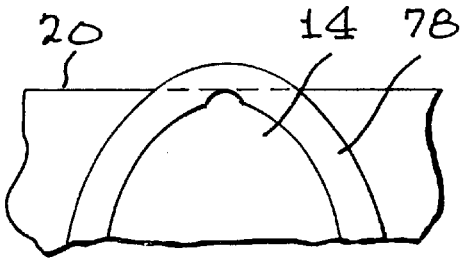
FIG. 3(b)
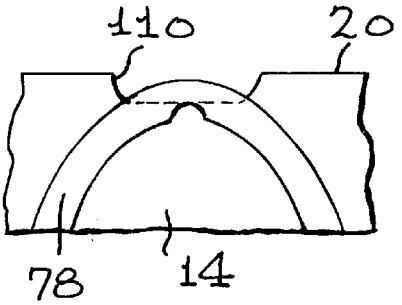
FIG. 3(c)

FIG. 3(a)
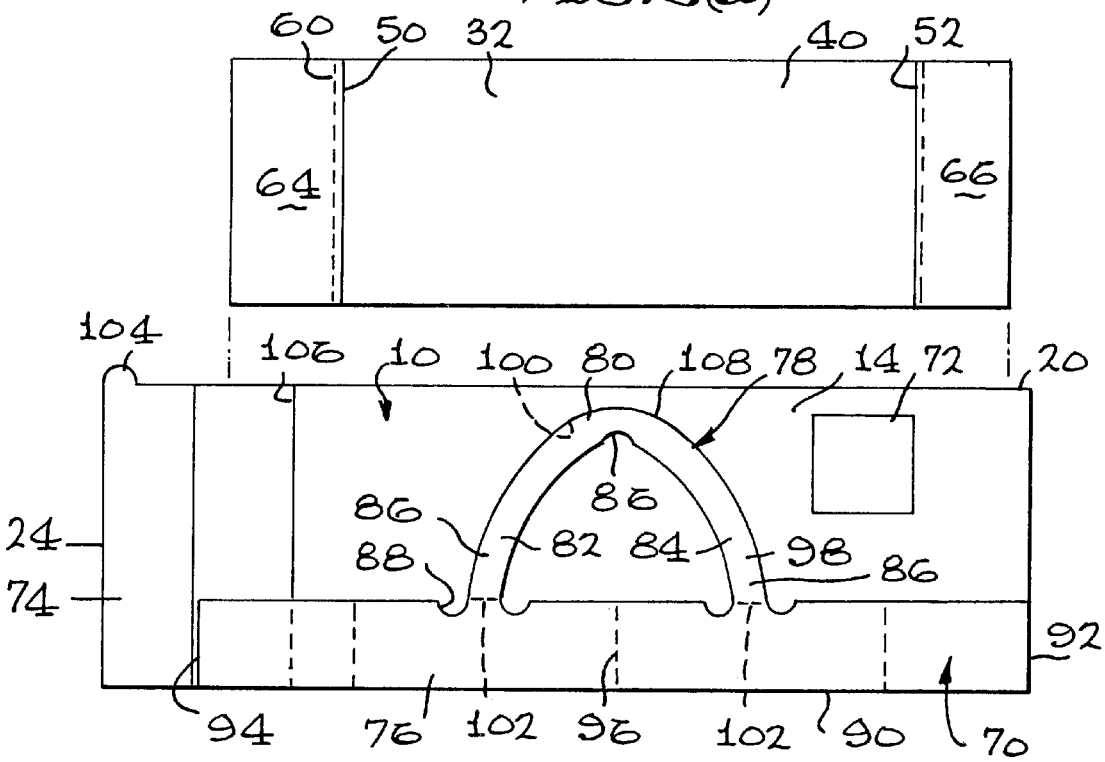
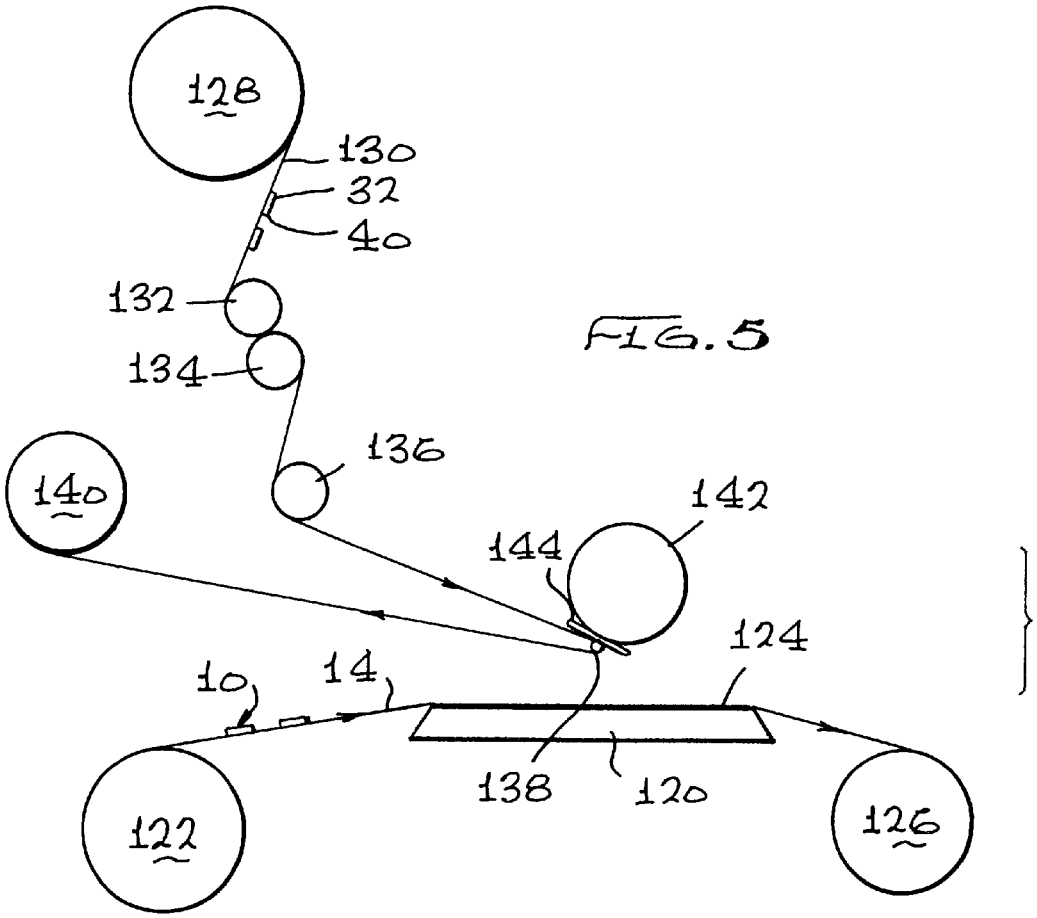
FIG. 5

LABEL WITH BOOKLET

FIELD AND BACKGROUND OF THE INVENTION

This invention relates to labels, and particularly for labels on bottles and other surfaces in a medical or health setting. The labels of the invention may comprise a base liner which is adhered to the surface, the base liner further having on an upper surface thereof at least a booklet which can be easily removed from the surface when needed. The upper surface of the liner may further include printed materials, hangers, peel-off labels or the like, all of which are located below the booklet.

A number of labels having booklets thereon are known in the art. Many of such labels are designed so that the booklet mounted thereon can be opened and resealed against the label. This permits multiple viewings of the contents of the booklet by opening and resealing a cover or other means holding the booklet.

U.S. Pat. No. 5,284,363 (Gartner) discloses a multi-layer hinged label as two layers which may be repeatedly partially separated and re-adhered to one another. As further background showing the prior art, U.S. Pat. No. 5,439,721 (Pedroli) teaches a label for packaged products and includes a bottom layer and an upper layer of clear plastic film laminated to the bottom layer so as to substantially cover a printed surface. The upper layer has a window cut therein to allow printing on the material below it.

Another example of the prior art is U.S. Pat. No. 5,021,273 (Kobayashi) which shows booklet type labels including outer label members with an adhesive band which can be peeled away to release the outer label member to expose the contents below. U.S. Pat. No. 5,679,427 (Instance) describes a self-adhesive label including self-adhesive edge portions on opposed sides of a multi-lamina label portion, the edge portions being releasably adhered to a portion of the label.

SUMMARY OF THE INVENTION

In one aspect, the present invention comprises a label having a liner comprising an upper surface and a lower surface, the lower surface having an adhesive thereon so that the label can be applied to a surface such as a bottle or the like, and a booklet comprising a plurality of pages, the booklet being located on the upper surface of the liner so that it can be easily removed and opened.

Preferably, the booklet, when removed, has no adhesive or sticky surfaces, projections or other materials which make it more difficult to handle.

In many instances when leaflets or other forms of foldable pages containing information are placed on a label, this is usually accomplished by having an adhesive material hold the booklet on the label, so that when the booklet is removed, there are adhesive edges or projections which interfere with the easy opening of the booklet. It is often convenient, especially in medical environments, to have a booklet on a label which can be easily removed, opened and read without the book having any adhesive surfaces which can interfere with the handling thereof. The invention teaches a label with booklet having these features.

Preferably, the booklet is located such that it covers the entire, or almost the entire, upper surface of the liner.

In another aspect, the label may further comprise a hanging ring on the upper surface of the liner, the hanging ring being constructed such that it can unfold to permit the bottle upon which the label is adhered to be suspended in an inverted position from a bracket, peg or the like.

The label may further comprise removable strips, for example, upon which the lot number, expiry date or other information can be written, the removable strip being easily separable from the remainder of the label. The label may additionally incorporate other types of peel-off or secondary labels.

In all instances where the label generally comprises the hanger, peel-off or other types of labels, the booklet is mounted so as to cover all these components, which become accessible once the booklet has been removed.

In one form, the booklet preferably comprises an elongate strip of paper which has been folded and refolded upon itself to form the booklet, and an adhesive cover which keeps the booklet on the remainder of the label. The cover preferably comprises an upper surface and a lower surface upon which an adhesive layer is applied. This adhesive layer adheres to the uppermost page of the booklet, and extends beyond the peripheral edges of the booklet so as to provide at least two edges which adhere to the base label. In one embodiment, the cover has perforations or lines of weakness which will easily tear when force is applied so that the booklet can be removed. The lines of weakness are preferably coextensive with the peripheral edge of the booklet so that that portion of the cover actually covering the booklet will be removed with the booklet when it is parted from the label, with the remainder of the cover portion remaining on the label. In this way, the booklet can be removed and easily read without having to deal with overhanging adhesive projections or portions, which may make it difficult to open an read the contents of the booklet.

The label including the booklet of the invention may be applied on bottles containing pharmaceutical products, and contain detailed information of the type typically found in boxes in which the bottle is wrapped. Therefore, an advantage of the invention is that the bottle (or other container) in which the pharmaceuticals are directly located need not be further packaged within a box, since the pharmaceutical information can be applied in a suitable manner directly to the bottle and be easily removed, where necessary.

In another aspect, the invention relates to a method for applying such labels, including booklets, to a bottle, and for making the label including the booklet.

In one preferred form, the method comprises a supply reel of base labels which is unwound and passed over a plate and thereafter taken up by a take-up reel. Over the plate, a further supply of booklets is provided, such that the application of the booklets to the base label is synchronized with the movement of the base labels over the plate. In a preferred form, both the booklet and labels are pre-arched so that when the label is applied to a bottle, it will not cause creasing or stretching. The amount of pre-arching in assembling the label with booklet of the invention will depend upon the size of the bottle to which the label is to be applied, with a smaller diameter of bottle requiring more extensive pre-arching.

BRIEF DESCRIPTION OF THE DRAWINGS

FIG. 1 is a diagrammatic top view of a label with booklet of the invention;

FIG. 2 is a bottom end view of the label with booklet as shown in FIG. 1;

FIG. 3(*a*) is a diagrammatic exploded view of a label with booklet showing the label with various components and the booklet mounted thereon;

FIG. 3(*b*) shows another embodiment of the label illustrated in FIG. 3(*a*);

FIG. 3(*c*) shows yet another embodiment of the label illustrated in FIG. 3(*a*);

FIG. 4 is a diagrammatic side view of the booklet with cover which forms part of the label with booklet of the invention; and FIG. 5 is a schematic representation showing the apparatus used for manufacturing a label with booklet of the invention.

DETAILED DESCRIPTION OF THE PREFERRED EMBODIMENT

Reference is now made to the drawings which show various forms and embodiments of a label with a booklet applied thereto. The label with booklet may simply comprise the liner and booklet, or it may comprise a liner including several other components, such as a hanging ring, peel-off label or secondary label. In those situations where the label with booklet includes these other components, these components would lie intermediate the liner and the booklet, with the booklet being applied so as to cover all of these structures.

FIG. 1 shows a version of the label with booklet without any of the other components forming part of the label. The label, generally designated by the reference numeral 10, comprises a liner 12, of generally rectangular and elongate shape mounted on a backing strip 15. The liner 12 has an upper surface 14 and a lower surface 16, the lower surface 16 including an adhesive layer 18. This adhesive layer 18 adheres to the backing strip 15 but is easily removable therefrom, and thereafter is applied and adhered to a surface, such as a bottle or other container to which the label will be applied.

The upper surface 14 of the label may include a printed layer with identifying information such as the name of the product, quantity or amount of the product to be contained in the bottle, and other basic information.

The backing strip 15 is a continuous strip of appropriate material which is designed to hold a plurality of labels 10 in a serial end-to-end arrangement, with each label 10 being easily removable from the backing strip 15. The label 10 has upper and lower edges 20 and 22 respectively, and side edges 24 and 26. The side edge 26 of one label 10 will be immediately adjacent, but separate from, the side edge 24 of an adjacent label 10. The upper and lower edges 20 and 22 correspond with, or are just slightly within, the upper and lower edges 28 and 30 of the backing strip 15.

On the upper surface 14 of the label 10, there is mounted a booklet 32 which comprises a plurality of pages. The pages may be formed by folding and refolding a continuous elongate strip of paper so as to form a book-like construction, or the booklet 32 may alternatively comprises a series of coextensive separate sheets formed in a stack. The booklet has a top page 34, best seen is FIG. 2 of the drawings, a bottom page 36 which rests directly on the upper surface 14 of the label 10, and one or more intermediate pages 38.

Extending over the top page 34 of the booklet 32, there is mounted a cover member 40, which is typically made of a thin plastic transparent or clear material. The cover member 40 is of slightly larger dimension than the various pages of the booklet, and has a top edge 42 and bottom edge 44 which extend slightly beyond the upper and lower edges of the booklet. Furthermore, the cover member comprises a pair of parallel side edges 46 and 48, extending beyond the side edges 50 and 52 of the booklet 32.

The cover member 40 has an upper surface 54, and a lower surface 56 upon which is formed an adhesive layer 58. The adhesive layer 58 extends generally over the entire area of the lower surface 56 of the cover member 40, and will therefore adhere to both the top page 34 of the booklet as well as the label 10 where it overextends the side edges 50 an 52 and/or top and bottom edges of the booklet.

The cover member comprises a perforation 60, or a line of weakness such as a score, along which the cover member may tear or come apart when a force is applied along the perforation. The perforation 60 is of rectangular shape, and is substantially coextensive with the outer periphery or edges of the booklet. When forces tear the perforation, the cover member 40 will separate so as to comprise a central rectangular portion which still adheres to the top page 34 of the booklet, and a rectangular peripheral strip 63 which remains adhered to the upper surface 14 of the label. Since the cover member 40 is generally transparent or clear, the remaining peripheral strip 63 on the upper surface 14 will not cover or otherwise obstruct any printed material or information on the upper surface 14.

Furthermore, where the upper surface 14 of the label contains other components, as will be described below, including, for example, a hanging ring with base, secondary or peel-off labels, the cover member 40 will be located on the upper surface 14 of the label 10 in such a manner so that it will not interfere with any of the functions or movements of these other components.

In the embodiment shown in FIG. 1, the cover member 40 has peripheral edges which extend beyond the peripheral edges of the booklet 32. In such case, the perforations extend all the way around the booklet, near the periphery thereof. However, in another embodiment, the upper and lower edges of the cover member may be precisely coextensive with the top and bottom edges of the book so that no perforations at or neat the top and bottom edges of the booklet will be required. In such an embodiment, only the side portions, represented by reference numerals 64 and 66 in FIG. 1, of the cover member 40 will adhere to the upper surface 14. Thus, the perforation 60 will only extend down the side edges 50 and 52, coextensive with the booklet, such that when the booklet is removed, only the side portions 64 and 66 will remain on the surface 14 of the label 10.

Reference is now made to FIG. 3(*a*) of the drawings which shows the basic label illustrated in FIG. 1, but also includes additional components on the label which are located intermediate the label 10 and the booklet 32. FIG. 3(*a*) shows an exploded view of the label 10, and the booklet 32, with an indication as to how the booklet 32, together with its cover 40 are substantially the same size as the label 10, and coextensive therewith. When the booklet 32 and cover 40 are located on the upper surface 14 of label 10, the entire label 10, or a substantial part thereof, will be covered by the booklet 32 and cover 40 combination.

In FIG. 3(*a*), it will be noted that the upper surface 14 of the label 10 has located thereon a hanger member 70, a peel-off label 72 and a secondary label 74. Each of these components is either mounted upon the upper surface 14 of the label 10, or integrated into the surface, as will be described below, so that they may be utilized once the booklet 32 and most of the cover 40 have been removed.

The hanging member 70 comprises a base elongate strip 76 extending across most of the entire length of the label 10, and a hanging ring 78 extending upwardly form the elongate strip 76. The hanging ring 78 comprises a central portion 80, and two side portions 82 and 84, the side portions having ends 86 which are integral and connected to the elongate strip 76. The central portion 80 of the hanging ring 78 includes a notch 86 which is adapted to receive a bracket or peg, and prevent the hanging ring 78 from sliding on the bracket, thus contributing to the stability of the bottle to which the label 10 may be attached.

The elongate strip has a pair of recessed or looped cut-outs 88 at each end 86 of side portions 82 and 84 which are continuous with the inner and outer edges of the side portions 82 and 84. These recessed cut-outs 88 help prevent tearing of the hanging ring 78 from the elongate strip 76 when the hanging ring 78 is supporting the weight of a bottle.

The elongate strip 76 has a lower surface which has an adhesive thereon, allowing it to be firmly and securely bonded to the upper surface 14 of the label 10. The lower edge 90 of the elongate strip is coextensive with the lower edge 22 of the label 14. The elongate strip 76 has a first side edge 92 which is substantially coextensive with the side edge 26 of the label, and a second side edge 94 which extends to near, but does not reach, the side edge 24 of the label 10. The space between the second side edge 94 on the elongate strip 76 and the side edge 24 of the label 10 is occupied by a secondary label 74, which will be briefly described below.

The elongate strip 76 has one or more scores or lines of weakness 96 extending transversely across its width. These scores 96 permit some stretching of the elongate strip 76 when applied onto a bottle. This stretching is advantageous and ensures that the label 10, or other components, will not crease as a result of the mounting of the label 10 and hanger member 70 on a bottle, where small differences in diameter may otherwise cause such creasing.

It will be noted that the perforations 60 in the cover member 40 may have a similar function (i.e. stretching), in addition to providing the ability to remove the booklet easily and without having adhesive edges or projections. Where perforations 60 are provided only at the side edges, and the upper and lower edges of the cover member 40 are coextensive with the upper and lower edges of the booklet member and no upper and lower tearing is therefore required, these perforations also provide the added advantage of permitting the booklet, which will have a slightly larger diameter than the label when mounted on a bottle, to stretch or otherwise adapt to this change.

The hanging member 78 has an upper surface 98 and a lower surface 100. Neither the upper nor lower surfaces 98 and 100 respectively have any adhesive thereon. Any adhesive which may have been on the lower surface is either deadened or covered, or, when adhesive is applied to the elongate strip 76 in order to enable it to bond strongly to the upper surface 14 of the label 10, such adhesive is not placed on the lower surface 100 of the hanging ring 78. The hanging ring 78 is therefore capable of movement between a first position, as shown in FIG. 3(*a*), where it is right up against the upper surface 14, and a second position, wherein the hanging ring folds about notional lines 102, which represent the boundary between the presence of adhesive on the elongate strip, and the absence of adhesive on the hanging ring 78. The hanging ring 78 folds through approximately 180°, so that the bottle upon which it is mounted can hang in an inverted manner. The ends 86 of the side portions 82 and 84 are spaced from each other by a distance which represents the diameter of the bottle, so that the bottle can hang in an inverted position, as is well known in the art.

The upper surface 14 of the label 10 shown in FIG. 3(*a*) also includes a peel-off label 72. The peel-off label 72 may be a "piggy-back" label which is applied on the upper surface, by means of an adhesive layer which is partially deadened to facilitate easy removal thereof and application onto another surface as desired. Alternatively, the peel-off label 72 may be a cut-out from the thickness of the upper surface 14 of the label 10, appropriately treated with adhesive deadeners or the like, so that it can be removed and applied to another surface as desired.

Reference is now made to the secondary label 74. The secondary label 74 is rectangular, and extends entirely between the upper and lower edges of the label 10. The secondary label 74 may include a pull-tab 104 so that it can be easily removed.

As described above, the label 10 comprises a liner 12 which is mounted on a backing strip 15. The label may be multi-laminate, comprising a base layer, and additional layers including printing layers so that relevant information can be seen on the label. The nature of the secondary label 74, and how it is configured with respect to the remainder of the label, will depend on the number of layers. Thus, the secondary label 74 may comprise a part of the liner 12 thickness, or all of the liner 12, but separated from the remainder of the label by a cut 106. The lower surface of the secondary label 74 would be treated with partial deadeners, or other processes, such that it can be removed from either the remainder of the label 10, or from the backing strip 15 or other surface on which its is mounted, and thereafter applied to another surface as desired. In other words, the lower surface of the secondary label would have adhesive properties sufficient to attach it to the label as a part thereof, but enable it to be fairly easily removed with its adhesive properties, and thereafter adhered to another surface.

Where the secondary label 74 comprises the entire thickness of the liner 12, and is not a layer or a portion of that thickness only, the secondary label 74 may be separated from the remainder of the label 10 by a series of tabs which ensure that the secondary label 74 does not become removed from the remainder of the label 10, especially when the label 10 is removed from the backing strip 15 and placed on a bottle.

In the embodiment in FIG. 3(*a*) of the drawings, the cover member 40 has its upper and lower edges coextensive with the upper and lower edges of the booklet 32. The side edges 50 and 52 of the booklet 32 are at or very near the perforations 60. When the cover 40 is torn along the perforations 60, the top page 34 of the booklet 32 will be substantially or entirely covered by the torn off portion of the cover member 40, but there will be little in the way of adhesive edges or projections on the removed booklet which may catch on other surfaces or otherwise interfere with the easy reading of the contents of the booklet 32.

It will also be noted that the side portions 64 and 66 of the cover member 40 would be applied to the upper surface 14 of the label 10 in such a manner so as not to interfere with any other components on the upper surface. Thus, the side edge 66, for example, would not be placed over the peel-off label 72, while the side edge 64 would be between the secondary label and the side portion 82 of the hanging ring, interfering with none of these components. It is important that the side portions 64 and 66 are so placed, since, after removal of the booklet 32, they remain on the upper surface and should not interfere with other components on the upper surface 14. Where there are no other components on the upper surface 14, it is, of course, not important where these remaining side portions 64 and 66 (or other remaining portions of the cover member) may be.

In another embodiment, the hanging ring 78 may be dimensioned such that its upper edge 108 on the central portion extends above the upper surface 20 of the label 10. This is shown in FIG. 3(*b*). The projection of this upper edge 108 makes it easier to access and use the hanging ring 78, since it will be easier to grip with the fingernails and separate it from the upper surface 14. In yet another embodiment, shown in FIG. 3(*c*),the hanging ring 78 does not extend beyond the upper edge 20 of the label, but a recess 110 is cut in the label 10 which, once again, allows the hanging ring 78 to be easily gripped and separated from the surface.

In yet another embodiment, the hanging ring 78, instead of being clear, is tinted a color, such as blue, or any other color that contrasts with the base, to make the hanging ring much more easy to identify on the label, and thus expedite its movement from the folded to the unfolded position when the bottle upon which it is mounted needs to be suspended in an inverted position.

Reference is now made to FIG. 4 of the drawings, which shows a more detailed view of the cover member 40 and the booklet 32. The cover 40 comprises a clear laminate layer 114 with the adhesive 58 clearly shown on the lower surface 56. The upper surface 54 of the cover has no adhesive. The perforations 60 are located near the edges of the cover member 40, and correspond substantially with the side edges 50 and 52 of the booklet. The upper surface of the top page 54 is adhered to the adhesive layer 58, while the bottom page 36 has a lower surface 116 which simply rests on the upper surface 14 (or other components) on the label 10. Thus, tearing the perforations 60 has the effect of removing all but the side portions 64 and 66 of the cover member 40, together with the booklet 32. Since the lower surface 116 simply rests on the upper surface 14 of the label 10, its removal is accomplished by simply lifting it off, and no remaining portions will stay on the upper surface 14. In the embodiment in FIG. 4, the booklet 32 comprises a continuous elongate strip of paper which is folded and refolded on itself to form a booklet. However, as mentioned above, any configuration of the booklet would be suitable, and it may therefore be comprised of separate pages, all of which may be joined along one of their edges.

Reference is now made to FIG. 5 of the drawings, which shows a system and method for manufacturing the label with booklet of the invention. The apparatus comprises a base plate 120 over which a continuous length of the backing strip 15, including the label 10 moves. The backing strip moves off a supply reel 122, over the upper surface 124 of the plate 120, and on to a take-up reel 126, which receives the finished product.

A booklet supply reel 128 is provided, and contains a continuous strip 130, comprising a backing upon which the booklet 32 with cover member 40 are mounted. The continuous strip 130 passes through a series of guide rollers 132, 134 and 136 and eventually passes over the upper surface 124 of the base plate 120. The continuous strip moves towards the guide roller 138, about which it moves through almost 180°, and then is taken up by take-up reel 140. At the guide roller 138, the booklet 32 and cover member 40 are removed from the continuous strip 130, and placed over the label 10 on the backing strip 114, as they move over the base plate 120. Of course, the movement of the continuous strip 130 and the backing strip 114 are synchronized to ensure that the booklet will be placed with precision over the label 10, in a manner as generally illustrated in FIG. 1. At the guide roller area 138, there is also located a brush roller 142 including a brush 144 which assists in the removal of the booklet 32 from its continuous strip 130 and cover 40 from the continuous strip 130, and places it as appropriate on the label 10.

The upper surface 124 of the base plate 120 may be rounded or otherwise contoured so that the label 10 is in a pre-arched condition when the booklet 32 and cover 40 are applied thereto. The extent of the arched contour can be preselected and varied, and would emulate the circumference of the bottle upon which the label with booklet is intended to be applied. This pre-arching is advantageous for two reasons. First, it enables a better fit of the label with booklet on the bottle, without any creasing or stretching of the various components, and, second, it allows the take-up reel 126 to receive and accommodate the label with booklets such that the booklet subjected to reduced amounts of squashing or creasing on this take-up reel 126. It will be appreciated that the take-up reel is circular, and, since the booklet is slightly radially outwardly arranged of the label 10, the arching facilitates both the easy packing on the take-up reel, as well as the mounting on a bottle.

The apparatus as shown in FIG. 5 may include appropriate sensors for detecting the position of the booklet and label as they unwind from their supply reels 122 and 128 respectively. The sensors ensure proper synchronization and application of the booklet on the label so that it is precisely mounted.

The booklet preferably covers the entire label, as well as components thereon such as the hanger, secondary label and peel-off label. It therefore offers some protection for these components while in the packing and application stage. However, the booklet may be smaller than the label, and the invention is not limited to booklets which entirely cover the label.

Some advantages of the invention include the fact that the perforated edges are arranged near the edges of the booklet so that after removal of the booklet form the label, there will be no adhesive edges which causes unnecessary sticking. Further, the application of the booklet on the label may well obviate the need for further packaging, such as the placing of the bottle in a box.

The invention is not limited to the precise details described herein, but variations and modifications are possible within the scope of the invention.

What is claimed is:

1. A composite label having a handle and a booklet, the label comprising:

a liner material;

a label having an upper and lower surface located on the liner, the label being secured to the liner by an adhesive layer on its lower surface, the adhesive layer being such that the label can be peeled off the liner with the adhesive remaining on the lower surface of the label;

a handle affixed to the upper surface of the label, the handle comprising an elongate strip having an upper and a lower surface and extending continuously across the entire length of the label, the lower surface of the elongate strip being firmly secured to the upper surface of the label by a strong bonding material, and a hanger portion integrally connected to the elongate strip and extending therefrom, the hanger portion having an upper surface and a lower surface with no adhesive thereon, the hanger portion being pivotable relative to the elongate strip so as to be movable between a first position wherein the hanger portion is adjacent the label portion, and a second position wherein the hanger portion is pivoted through substantially 180° from the first position;

a booklet affixed to the upper surface of the label so as to overlie handle, the booklet comprising a plurality of stacked pages having edges including a top page and a bottom page, each of the pages being coextensive with each other and of smaller dimensions than the label, the booklet further comprising a cover member entirely covering the top page and extending beyond at least two opposing edges of the top page, the cover member having an upper non-adhesive surface, and a lower surface having an adhesive thereon by means of which the lower surface of the cover member is permanently adhered to the upper surface of the top page;

the booklet being completely removable from the label by removing at least a portion of the cover member.

2. A label with booklet as claimed in claim 1 wherein the cover member is of substantially the same dimensions as the label, so as to completely or substantially cover the label.

3. A label with booklet as claimed in claim 2 wherein the booklet has upper and lower edges which are substantially coextensive with the upper and lower edges of the cover member, with the cover member extending beyond side edges of the booklet, whereby the booklet is affixed to the label.

4. A label with booklet as claimed in claim 1 wherein the cover member comprises a series of perforations or lines of weakness, the perforations being coextensive with the periphery of the booklet, the booklet being removable by tearing the cover member along the perforations or lines of weakness such that no cover member projections or edges having adhesive thereon are attached to the booklet after removal thereof.

5. A label with booklet as claimed in claim 1 wherein the cover member includes one or more tabs to facilitate gripping thereof when removing the booklet from the label.

6. A label with booklet as claimed in claim 5 wherein the tab comprises an outwardly extending projection of the cover member, and the pages of the booklet have correspondingly shaped and located projections.

7. A label with booklet as claimed in claim 1 wherein additional components are located on the upper surface of the label, and the booklet and cover member extend over and cover the additional components.

8. A label with booklet as claimed in claim 1 wherein the elongate strip comprises at least one score to form a line of weakness along at least a part of its width.

9. A label with booklet as claimed in claim 1 wherein the hanger comprises a semi-circular ring portion and a pair of depending leg portions, each leg portion having one end thereof connected to the elongate strip.

10. A label with booklet as claimed in claim 1 further comprising a secondary peel-off label on the label, the peel-off label being die cut within the label so as to be removable therefrom.

11. A label with booklet as claimed in claim 1 further comprising:

a removable label mounted on one side of the label, the removable label being located on the upper surface of the label and being adhered thereto such that the removable label can be easily removed form the upper surface of the label; and a permanent label mounted on the label, the elongate strip of the handle extending over the permanent label and not covering the removable label.

12. A label with booklet as claimed in claim 1 wherein the booklet comprises an elongate strip folded and refolded upon itself so as to provide stacked pages in the form of a book.

13. A label with booklet as claimed in claim 1 wherein the booklet comprises a series of discreet pages joined together at one edge thereof.

14. A label with booklet as claimed in claim 1 wherein the top page is connected by an adhesive to the lower surface of the cover, and the bottom page rests upon the upper surface of the label, without being affixed thereto.

* * * * *